United States Patent [19]

Ishii et al.

[11] Patent Number: 4,907,557

[45] Date of Patent: Mar. 13, 1990

[54] FUEL INJECTION SYSTEM FOR INTERNAL COMBUSTION ENGINE

[75] Inventors: Shoso Ishii; Minoru Kuriyama, both of Hiroshima; Yukinobu Nishimura; Setsuhiro Shimomura, both of Himeji, all of Japan

[73] Assignee: Mitsubishi Denki Kabushiki Kaisha, Tokyo, Japan

[21] Appl. No.: 256,021

[22] Filed: Oct. 11, 1988

[30] Foreign Application Priority Data

Oct. 14, 1987 [JP] Japan ..... 62-258762

[51] Int. Cl.[4] ..... F02D 41/04

[52] U.S. Cl. ..... 123/488; 123/478

[58] Field of Search ..... 123/478, 480, 486, 488, 123/494

[56] References Cited

U.S. PATENT DOCUMENTS

| | | | |
|---|---|---|---|
| 4,497,297 | 2/1985 | Daniel et al. | 123/440 |
| 4,582,031 | 4/1986 | Janetzke et al. | 123/478 X |
| 4,694,806 | 9/1987 | Wataya et al. | 123/488 X |
| 4,719,890 | 1/1988 | Wataya et al. | 123/488 |
| 4,803,966 | 2/1989 | Denz | 123/478 |

*Primary Examiner*—Tony M. Argenbright

*Attorney, Agent, or Firm*—Sughrue, Mion, Zinn, Macpeak and Seas

[57] ABSTRACT

A fuel injection system includes a valve for supplying fuel to an internal combustion engine; a device for measuring the quantity of air passing through an air intake passageway in both forward and backward directions; a device for detecting the number of revolution of the engine; a device for detecting conditions of the engine; a limiting device, which is used when an output therefrom produces a time width of a pulse to be imparted to the fuel injection valve, and which limits variables related to the atmospheric pressure including a measured value of the air quantity limited by the number of engine revolutions; and an atmospheric pressure conformed corrective value computing device. Reference values of the variables at a predetermined atmospheric condition are stored with the number of engine revolutions as a parameter, and an atmospheric condition is computed by introducing an input signal corresponding to the parameter from the condition detecting device and an output signal from the air quantity measuring device or the limiting device, the latter correcting the limited value in conformity to the atmospheric pressure in accordance with the atmospheric pressure conformed corrective value.

11 Claims, 11 Drawing Sheets

FUEL INJECTION SYSTEM FOR INTERNAL COMBUSTION ENGINE

BACKGROUND OF THE INVENTION

1. Field of the Invention

This invention relates to a fuel injection system for the internal combustion engine, and, more particularly, it is concerned with the fuel injection system using an air flow sensor (hereinafter abbreviated as "AFS") for detecting an air flow rate in both forward and backward directions.

2. Discussion of Background

In the following, a conventional fuel injection system for the internal combustion engine will be explained in conjunction with FIGS. 1 and 2 of the accompanying drawing which illustrate one embodiment of fuel injection system according to the present invention.

In FIG. 1, a reference numeral 1 designates an internal combustion engine which is mounted on an automobile, etc., and in which only one cylinder is shown out of a plurality of cylinders; a numeral 2 refers to a cylinder of the internal combustion engine 1; a numeral 3 refers to an air intake valve to be driven by a cam (not shown in the drawing); a reference numeral 4 designates an intake manifold of the internal combustion engine 1; a numeral 5 denotes a surge tank which is connected to the upstream side of the intake manifold 4; a numeral 6 refers to an intake air temperature sensor for detecting temperature of the intake air; a reference numeral 7 designates a throttle valve provided in the air inlet passage which is at the upstream of the surge tank 5 and for controlling the intake air quantity into the internal combustion engine 1; a reference numeral 8 denotes a sensor connected to the throttle valve 7 and for detecting a degree of opening of the throttle valve; a numeral 9 refers to a bypass which functions to detour both upstream and downstream of the throttle valve 7; a numeral 10 refers to a bypass air quantity regulator provided in the bypass 9; a numeral 11 refers to a heat-wire type AFS which is provided at a location further upstream of the throttle valve 7 and for detecting an air quantity to be taken into the internal combustion engine 1 by means of, for example, a temperature-dependent-resistor; a reference numeral 12 designates an air cleaner provided at an intake port situated at the upstream of the AFS 11; a reference numeral 13 represents a fuel-injection valve for feeding by injection the fuel into the internal combustion engine, the fuel-injection valve being provided in the intake manifold 4 for each and every cylinder 2; a reference numeral 14 designates a water temperature sensor for detecting temperature of the cooling water in the internal combustion engine 1; a numeral 15 refers to a crank angle sensor for detecting a predetermined crank angle of the internal combustion engine 1; a numeral 16 refers to a starter switch; a reference numeral 17 designates a neutral detection switch; a reference numeral 18 designates an electronic control unit (hereinafter abbreviated as "ECU") for controlling the fuel injection quantity from the fuel injection valve 13 to take a predetermined air/fuel proportion with respect to the air quantity to be taken into each of the cylinders of the internal combustion engine 1, the ECU functioning to determine the fuel injection quantity based principally on those signals from the AFS 11, the water temperature sensor 14, the crank angle sensor 15 and the starter switch 16 to thereby control a fuel injection pulse width in synchronism with the signal from the crank angle sensor 15.

In the following, the detailed construction of the above-mentioned ECU will be explained. Referring first to FIG. 2 of the accompanying drawing, a reference numeral **18*a* designates a digital interface for introducing input digital signals from the crank angle sensor 15, the starter switch 16, the neutral detection switch 17, and so on. This digital interface 18*a* is connected to an input port or an interruption terminal of a CPU (central processing unit) 18*e*. A reference numeral 18*b* designates an analog interface for introducing input analog signals from the intake air temperature sensor 6, the throttle valve opening degree sensor 8, the AFS 11, the water temperature sensor 14, and so forth. The outputs from this analog interface 18*c* are sequentially selected by a multiplexer 18*c*, subjected to the digital/analog conversion by means of an A/D converter 18*d*, and taken into the CPU as the digital values. The CPU 18*e* is a well known mico-processor comprising control programs, data-inscribed ROM, and a timer, and generates by means of a timer output a fuel injection pulse width which is computed by the predetermined control programs. A reference numeral 18*f* denotes a drive circuit which is for driving the fuel injection valve 13** with the above-mentioned pulse width.

FIG. 11 is a block diagram for explaining in further details the conventional operations of the above-mentioned CPU **18*e*. In the drawing, a reference numeral 181 designates an engine-revolution detecting section which converts a cycle of square wave signals generated from the crank angle sensor 15 into the number of revolution of the internal combustion engine; a reference numeral 182 denotes an average air quantity detecting section for finding out an average air quantity by converting the voltage of the AFS 11 into an air flow rate, and averaging the thus converted flow rate between the signals from the crank angle sensor; a numeral 183 refers to an air quantity limiter, which is constructed with a maximum air quantity computing section 183*a* for finding out the maximum air quantity in a reference atmospheric condition as established in correspondence to the number of revolution of the internal combustion engine and a limiting section 183*b* for limiting the upper part of an output from the average air quantity detecting section 182 with the output from the maximum air quantity computing section 183*a*; a reference numeral 184 designates a charging efficiency calculating section for finding out a charging efficiency ($\eta$) by dividing an output from the air quantity limiter 183 by an output from the engine-revolution detecting section 181, the dividend of which is multiplied by a predetermined coefficient; and a numeral 185 refers to an injection pulse width computing section for finding a time width of a pulse for the fuel injection quantity by multiplying an output from a warming-up load calculating section 186 which generates a loading coefficient ($C_{wt}$) in accordance with an output from the water temperature sensor 14 and the above-mentioned charging efficiency ($\eta$), and then by further multiplying a discharge quantity coefficient (R) of the fuel injection valve 13**.

In the foregoing, the construction of the conventional fuel injection device for the internal combustion engine has been described in detail. Now in the following, particular explanations will be given as to the necessity for providing the air quantity limiter 183 shown in FIG. 11.

For the fuel control of the internal combustion engine 1, there is effected detection by the AFS 11 of an air quantity which is supplied from the air cleaner 12 into the surge tank 5 by way of the intake manifold 4, as shown in FIG. 1, and then detection of the temperature of the intake air by the intake air temperature sensor 6. In case, however, of using the AFS 11 for the automobile, etc., there may possibly take place reversal in the flow of the air.

Such reversed flow may become considerable in most cases when the throttle valve 7 is in its full open condition with a number of revolution of the internal combustion engine ranging from 1,000 to 3,000 rpm. For the sake of simplicity, this reversed flow of air will hereinafter be termed as "back-flow". When this back-flow occurs, the AFS 11 would detect in principle the quantity of even such back-flow air, owing to which the AFS effects excessive measurement of the air quantity which is taken into the cylinder 2 of the internal combustion engine 1. Further, this measured value reaches, in some cases, from 1.5 to 2 times as large as the normal value, and, in the absence of appropriate measured being taken, the feeding quantity of fuel into the internal combustion engine 1 becomes excessive. In order therefore to avoid such erroneous and excessive injection of fuel from the fuel injection valve 13, the air quantity limiter 183 is provided. This air quantity limiter 183 functions to avoid the excessive supply of the fuel through the mis-calculation done by the above-mentioned AFS 11 by first finding out a real value of the intake air quantity for the internal combustion engine 1 under the reference conditions of the atmospheric pressure and temperature in accordance with the number of engine-revolution, storing this value of the intake air quantity as the mapping data for the number of revolution of the engine, and limiting an output from the average air quantity detecting section 182 based on the mapping data for the number of revolution of the engine.

Since the conventional fuel injection device of the internal combustion engine is constructed as mentioned above, when, for example, an automobile is driven at a high elevation, the air quantity limiter 183 is not capable of controlling the air quantity to an appropriate limit value in correspondence to reduction in the atmospheric pressure. On account of this, there occurs various problems such that an excessive quantity of fuel is supplied to the internal combustion engine 1 during the vehicle driving with the throttle valve 7 being in full-open condition at a low engine revolution, and others. The reason for this is that, at a high elevation of 3,000 m above the sea level, for instance, the atmospheric pressure becomes as low as 530 mmHg, owing to which the fuel is supplied in excess of approximately 30% with the full-open throttle valve, thereby causing disorder in the internal combustion engine 1. While this problem may be solved by use of an atmospheric pressure sensor, there is a new problem of increased cost for its installation.

SUMMARY OF THE INVENTION

The present invention has been made with a view to solving the afore-described points of problem, and aims at providing an improved fuel injection system for the internal combustion engine, which is capable of correcting the fuel injection quantity in conformity to the atmospheric pressure without use of the atmospheric pressure sensor.

With a view to attaining the above-mentioned object, the fuel injection device for the internal combustion engine according to the present invention is so constructed that it incorporates therein an atmospheric pressure conformed corrective value computing means which stores therein reference values for variables in the predetermined atmospheric conditions with a number of engine-revolution at least as a parameter, introduces thereinto a signal corresponding to the parameter and also an output from the air quantity measuring means or air quantity limiting means, and computes an atmospheric pressure conformed corrective value during a predetermined operating condition of the internal combustion engine, so that the air quantity limiting means may correct the limit value of the variables with the atmospheric pressure conformed corrective value.

The fuel injection device for the internal combustion engine according to the present invention operates in such a manner that the atmospheric pressure conformed corrective value computing means takes out the reference values for the variables under the predetermined atmospheric conditions corresponding to an input signal thereto, takes a ratio between the reference value and an output from the air quantity measuring means or the air quantity limiting means to compute an atmospheric pressure conformed corrective value which is a ratio of the atmospheric pressure to a reference atmospheric pressure, and limits the pulse width to be applied to the fuel injection value with the limited variables so that the limiting means may correct the limit value of the variable with this atmospheric pressure conformed corrective value to thereby limit the variables. In this way, there can be prevented excessive supply of the fuel.

The foregoing object, other objects as well as the specific construction and functions of the fuel injection system for the internal combustion engine according to the present invention will become more apparent and understandable from the following detailed description of a few preferred embodiments thereof, when read in conjunction with the accompanying drawing.

BRIEF DESCRIPTION OF THE ACCOMPANYING DRAWING

In the drawing:

as illustrated in FIG. 1;

DETAILED DESCRIPTION OF PREFERRED EMBODIMENTS

In the following, the present invention will be described in specific details in reference to the accompanying drawing.

Figure 1:
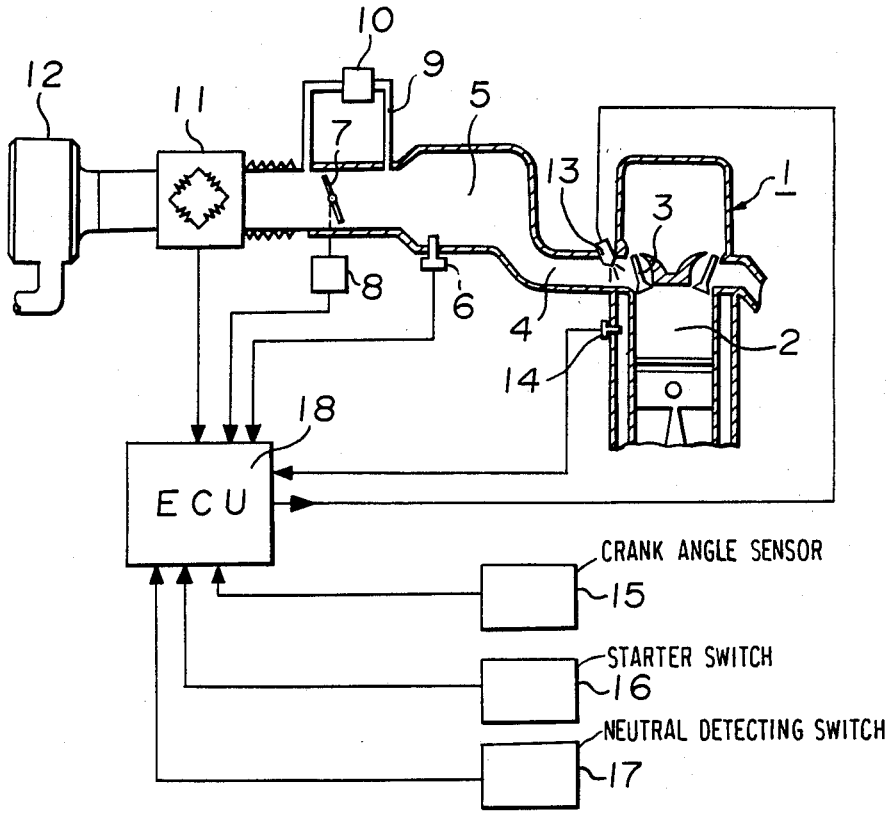
FIG. 1 is a schematic structural diagram showing an overall fuel injection system for the internal combustion engine according to one embodiment of the present invention.
Figure 2:
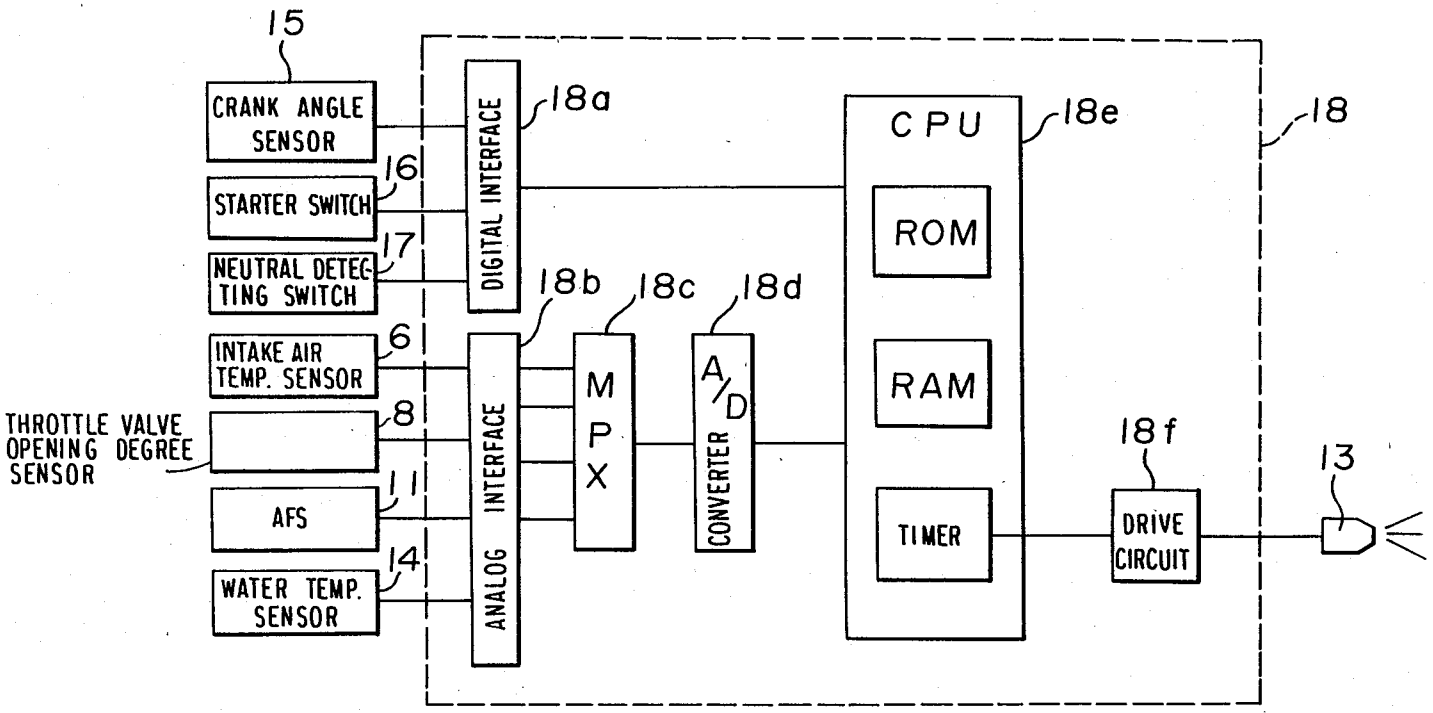
FIG. 2 is a block diagram showing in detail the ECU and related sensors, etc.
Figure 3:
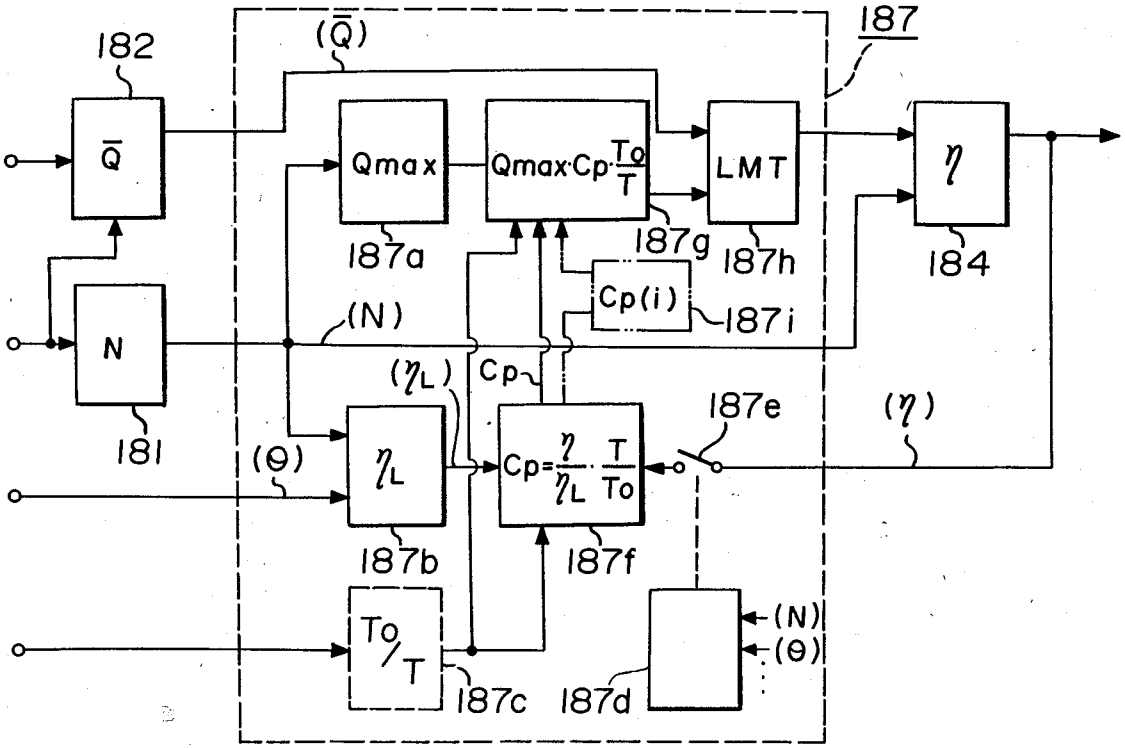
FIG. 3 is also a block diagram showing an internal structure of CPU according to the first embodiment of the present invention.

FIGS. 1 and 2 illustrate the construction of the fuel injection system according to a preferred embodiment of the present invention, in which the central processing unit (CPU) 18*e* in the ECU 18 has the specific construction as shown in FIG. 3.

Figure 4:
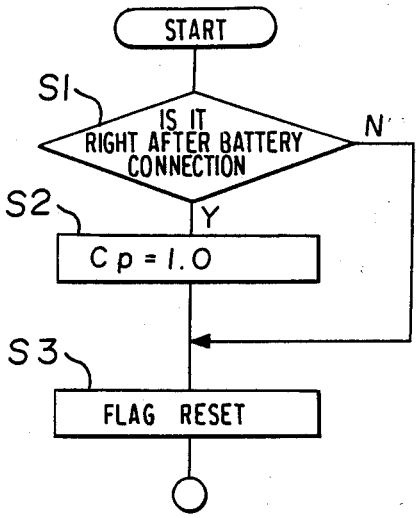
FIGS. 4 to 6 are respectively flow charts showing the operational sequences of the CPU according to the first embodiment of the present invention.
Figure 5:
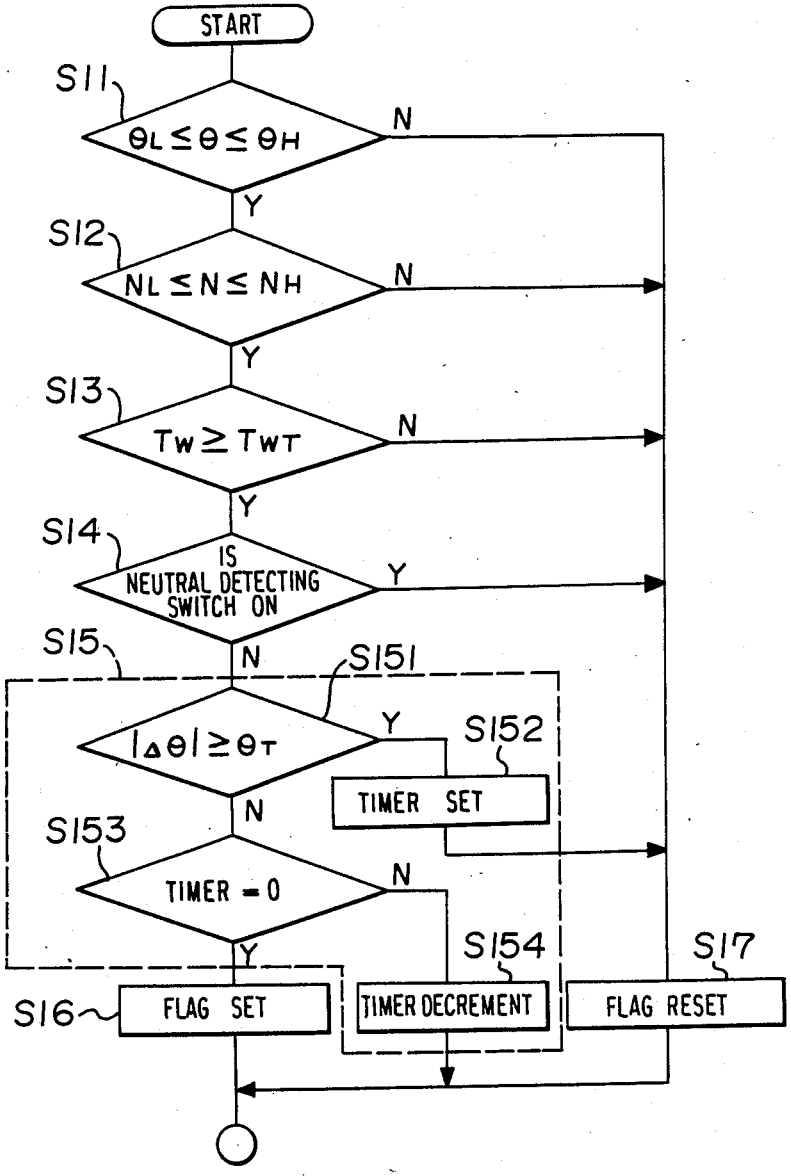
Figure 6:
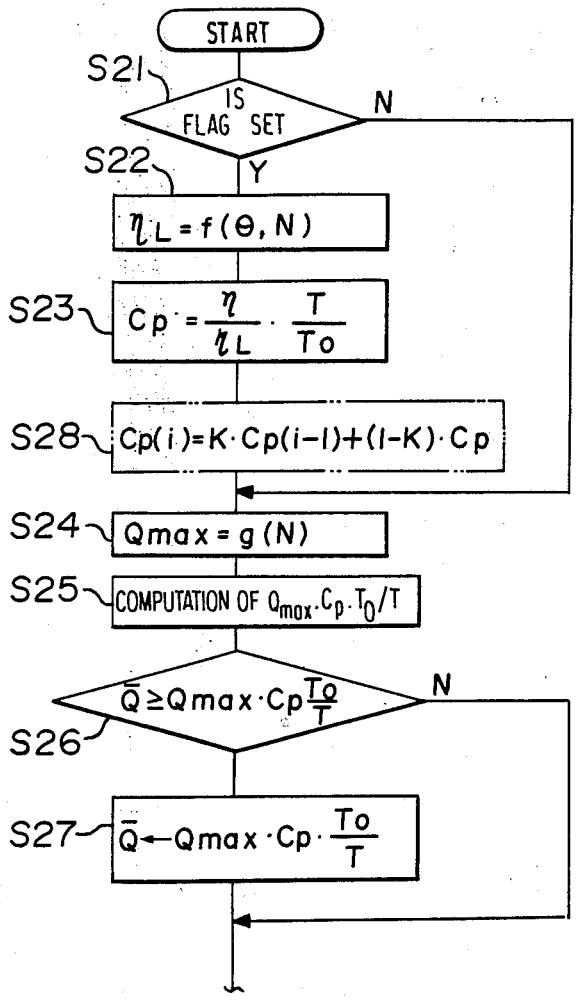
Figure 11:
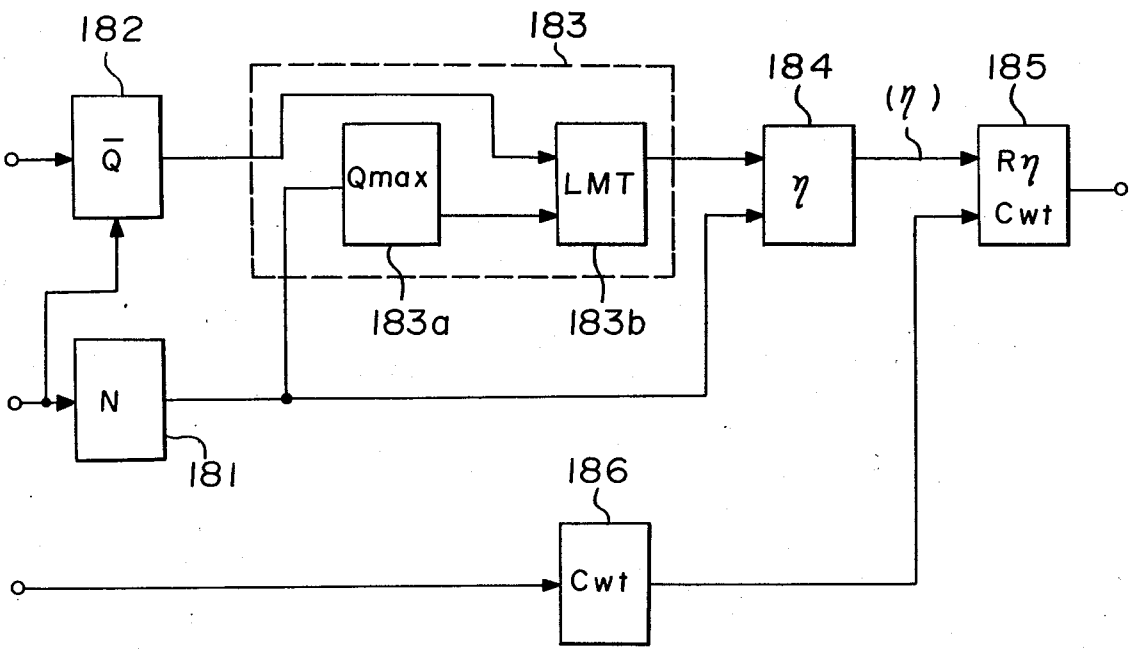
FIGURE 11 PRIOR ART
FIG. 11 is a block diagram schematically showing the structure of a conventional fuel injection system.

The construction of this fuel injection system has already been explained in the foregoing for the prior art, with the exception that the flow programs and numerical values as shown in FIG. 4 to 6 are stored in the ROM, hence the explanations thereof will be dispensed with. Also, in FIG. 3, the same reference numerals as in FIG. 11 designate the identical or corresponding parts, and their explanations will be omitted.

A reference numeral 187 designates an air quantity limiter, which is constructed with the following components:

(i) a maximum air quantity computing section 187*a*, into which an output from the engine-revolution detecting section 181 is introduced as an input thereto, and in which there is stored in advance in the form of a mapping data a maximum air quantity ($Q_{max}$) in the reference atmospheric conditions [atmospheric pressure ($P_O$) and temperature ($T_O$)]as established in correspondence to the number of engine-revolution;

(ii) a reference charging efficiency calculating section 187*b* which introduces thereinto an input signal of the number of engine revolution (N) from the engine-revolution detecting section 181 as well as an input signal of a degree of opening ($\theta$) of the throttle valve 7 from the throttle valve opening degree sensor 8, computes a reference charging efficiency ($\eta_L$) under the reference atmospheric conditions [atmospheric pressure ($P_O$) and temperature ($T_O$)], and produces the result of calculation as an output therefrom; this reference charging efficiency calculating section 187*b* stored therein beforehand the reference charging efficiency ($\eta_L$) in the reference atmospheric pressure ($P_O$) and reference temperature ($T_O$)in the form of a mapping data with the number of engine-revolution (N) and the throttle valve opening degree ($\theta$) as the parameters; the above-mentioned reference charging efficiency ($\eta_L$) may be calculated in advance by differently determining the air flow rate at the number of engine-revolution, the reference atmospheric pressure ($P_O$), and the reference temperature ($T_O$), and the thus calculated value is stored therein; in addition, the reference charging efficiency ($\eta_L$) has the following relationship:

$$\eta_L = k(\theta, N) \cdot P_O / T_O \quad (1)$$

(where: k is a proportional constant which depends on $\theta$ and N);

(iii) an air temperature correcting section 187*c* which divides a reference temperature ($T_O$) by a temperature (T) detected by the intake air temperature sensor 6, and produces an output signal of the air temperature corrected value ($T_O/T$);

(iv) a condition judging section 187*d* which functions to introduce as inputs thereinto various signals of the number of engine-revolution (N) detected by the engine-revolution detecting section 181, the degree of opening ($\theta$) of the throttle valve 7 detected by the throttle valve opening degree sensor 8, the cooling water temperature ($T_w$) detected by the water temperature sensor 14, and other signals from the neutral detecting switch 17, etc., and, which turns on a switch 187*e* connected to an output terminal of the charging efficiency calculating section 184 only during the steady engine operations where the predetermined conditions are established;

(v) an atmospheric pressure conformed corrective value calculating section 187*f* which introduces as the inputs thereinto a signal of the reference charging efficiency ($\eta_L$) from the reference charging efficiency calculating section 187*b*, an output signal of the air temperature corrected value ($T_O/T$) from the air temperature correcting section 187*c*, and a signal of the charging efficiency ($\eta$) from the charging efficiency calculating section 184 only when the switch 187*e* is on; computes the atmospheric pressure conformed corrective value ($C_p$) in accordance with the following Equation (2), only when the switch 187*e* is on; and produces the result of the computation as an output therefrom:

$$C_p = P/P_O = \eta/\eta_L \cdot T/T_O \quad (2)$$

here, if the number of revolution is represented by N, the throttle valve opening degree by $\theta$, the atmospheric pressure (absolute pressure) by P, and the temperature (absolute temperature) by T, the charging efficiency can be expressed as follows:

$$\eta = k(\theta, N) \cdot P/T \quad (3)$$

as the consequence, it is seen that, when the proportional constant $k(\theta,N)$ is eliminated from the Equations (1) and (3), the Equation (2) can be established;

(vi) a multiplier 187*g* which introduces as the inputs thereinto various signals such as the maximum air quantity ($Q_{max}$) from the maximum air quantity computing section 187*a*, the temperature corrected value ($T_O/T$) from the air temperature correcting section 187*c*, and the atmospheric pressure conformed corrective value ($C_p$) from the atmospheric pressure conformed corrective value calculating section 187*f* and produces therefrom an output signal of the upper limit air quantity ($Q_{max} \cdot C_p \cdot T_O/T$) by multiplication of these input signals; and (vii) a limiting section 187*h* which compares magnitude of the average air quantity ($\bar{Q}$) detected by the average air quantity detecting section 182 and magnitude of the upper limit air quantity ($Q_{max} \cdot C_p \cdot T_O/T$) multiplied by the multiplier 187*g* and, in accordance with the result of comparison, sets the upper limit of the average air quantity ($\bar{Q}$) to thereby produce this upper limit value of the air quantity as an output to the charging efficiency calculating section 184.

By the way, the above-mentioned maximum air quantity computing section 187*a* and the limiting section 187*h* are of the same type as used in the conventional fuel injection system. Further, since computation of the pulse width for the fuel injection by use of the charging efficiency ($\eta$) at the later stage of the charging efficiency calculating section 184 is well known, it is omitted from the block diagram.

In the following, explanations will be given as to the operations of the CPU 18*e* shown in the block diagram in additional reference to the flow charts in FIGS. 4 to 6.

FIG. 4 is a flow process chart showing the initialization routine after closure of the power source. At the step S1 in this flow chart, judgement is made as to whether the operation started immediately after connection to the power source battery, or not. This determination can be done by used of, for example, a stand-by power bit for the CPU which is available in the general commercial market. If it is immediately after connection to the battery, the atmospheric pressure conformed corrective value ($C_p$) is established at "1" at the step S2 to thereby effect the initialization of the atmospheric pressure conformed corrective value ($C_p$). On the other hand, if it is not immediately after the connection to the battery, no initialization is effected, because the atmospheric pressure conformed corrective value ($C_p$), which was stored at the time of the previous switch having been turned off, is backed up by the RAM in the CPU 18*e*. After the negative judgement at the step S1 or the completion of the process at the step S2, the flag is initialized (i.e., resetting) at the subsequent step S3 to thereby terminate the interruption routine.

FIG. 5 is a flow process chart showing the operations of the condition judging section 187*d* shown in FIG. 3. In this flow chart, judgement is made at the step S11 as to whether the opening degree ($\theta$) of the throttle valve is within a predetermined range between ($\theta_H$) and ($\theta_L$), or not; then, judgement is made at the step S12 as to whether the number of engine-revolution (N) is within a predetermined range between ($N_H$) and ($N_L$), or not; thereafter, judgement is made at the step S13 as to whether the cooling water temperature ($T_w$) is above its predetermined value ($T_{wt}$), or not; and finally judgement is made at the step S14 as to whether the neutral switch 17 is turned on, or not, (i.e., whether the power transmission gear is in its neutral position or in its engaged position). When all of the above-mentioned four conditions are met, the operational sequence proceeds to the step S15. If, however, any one of these conditions is not met, the operational sequence immediately goes to the step S17 at the instant of non-establishment of these conditions. By the way, it should be mentioned that the lower limit value of the opening degree ($\theta_L$) for the throttle valve opening degree ($\theta$) is set to avoid any increase in error in the absolute value of the charging efficiency which is small and its fluctuation inevitably affects the error. The actual value for the opening degree of the throttle valve should therefore preferably be 15 degrees or above. On the other hand, the upper limit value of the opening degree ($\theta_H$) is determined in such a manner that no back-flow may take place, which may usually be in a range of from 50 to 60 degrees. More precisely, it is desirable that both upper and lower limit values of the opening degree ($\theta_H$) and ($\theta_L$) be in the form of a mapping data with the number of revolution (N) being the parameter. While the upper and lower limit values ($N_H$) and ($N_L$) of the number of engine-revolution are not particularly required with the exception of a case where the number of revolution is low, it is desirable that, for the convenience in the mapping computations, this number of engine-revolution be limited to an ordinary operating range of the engine. The limiting conditions of the cooling water temperature ($T_w$) is set by taking into consideration a case wherein air is supplied into the internal combustion engine 1 from outside other than the throttle section through the bypass air regulator 10, when the temperature is low. It is desirable that the temperature ($T_{wt}$) of the cooling water may usually be set in a range of from 60° C. to 80° C. The condition for judging the gear engagement at the step S14 is so effected that, in the case of the neutral position, any fluctuation in the engine operating state, which readily occurs during the neutral condition, may be removed.

The step S15 is a routine section for judging the steadiness of the engine operation, in which the step S151 determines whether $|\Delta\theta|$ which is an absolute value of a deviated value of the throttle valve opening degree ($\theta$) at every predetermined time as found from a routine (not shown in the drawing) is greater than a predetermined value ($\theta_T$), or not. If the relationship is such that $|\Delta\theta| \geqq \theta_T$, a timer is set at the step S152. On the other hand, if the relationship does not reach $|\Delta\theta| < \theta_T$, judgement is made at the step S153 as to whether the value of the time is zero, or not. If the timer value is zero, the flag is set at the step S16. On the contrary, if the timer value is not zero, it is decremented at the step S154. In the above-described manner, a transitional state is detected at the step S15 by use of the absolute value $|\Delta\theta|$ of a deviation in the throttle valve opening degree, according to which a predetermined time period after the detection is regarded as the transitional state, while any other time not regarded as the transitional state is judged as the steady state and the flag is set thereby. If any one of the conditions in the steps S11 to S14 is not met, or after completion of the step S152, the operational sequence proceeds to the next step S17 where the flag is reset. By the above-mentioned operational sequence, the routine as shown in the flow chart of FIG. 5 is terminated.

FIG. 6 is a flow process chart showing a routine for correcting the maximum air quantity in conforming to the atmospheric pressure. In the flow chart, judgement is first made at the step S21 as to whether the above-mentioned flag is in a state of its being set or reset. If it is in the set state, the operational sequence proceeds to the subsequent step S22, and if it is in the reset state, the operational sequence goes to the step S24 to be described later. The reference charging efficiency calculating section 18*b*, into which a signal representing the number of revolution (N) from the engine-revolution detecting section 181 and a signal representing the throttle valve opening degree from the throttle valve opening degree sensor 8 have been introduced as inputs thereto, functions to extract from the data map, at the step S22, based on these input signals, the reference charging efficiency ($\eta_L$) under the reference atmospheric conditions [atmospheric pressure ($P_O$) and temperature ($T_O$)] which correspond to the values N and $\theta$ in the data map. After the step S22, the operational sequence proceeds to the step S23 where the signal of this reference charging efficiency ($\eta_L$) as extracted is introduced as an input thereto, and the atmospheric pressure conformed corrective value calculating section 187*f*, into which a signal representing the charging efficiency ($\eta$) from the charging efficiency calculating section 184 owing to the switch 187*e* having been turned on by the condition judging section 187*d* where the flag is judged to be in its set state, and an output signal of the temperature corrected value ($T_O/T$) from the air temperature correcting section 187*c* have been introduced as the inputs thereto, functions to calculate the atmospheric pressure conformed corrective value ($C_P$) in accordance with the foregoing Equation (2).

At the step S21, if the flag in its reset state, the switch 187*e* is turned off, and the atmospheric pressure conformed corrective vaslue calculating section 187*f* does not compute the atmospheric pressure conformed corrective value ($C_P$). In this case, the previously calculated atmospheric pressure conformed corrective value ($C_P$), which is initialized to "1" as mentioned above or which has a already been stored in the RAM, is used at the step S25, etc. to be mentioned later.

After the processing at the step S23 or after the judgement of the reset state of the flag at the step S21, the maximum air quantity computing section 187*a* extracts from the map, at the step S24, the maximum air quantity ($Q_{max}$) corresponding to the number of engine-revolution (N), based on an input signal of the number of revolution (N) from the engine-revolution detecting section 181. After the step S24, the operational sequence proceeds to the step S25 where the multiplier 187*g*, which has introduced therein an input signal of the maximum air quantity ($Q_{max}$) from the maximum air quantity computing section 187*a*, an input signal of the temperature corrected value ($T_O/T$) from the air temperature correcting section 187*c*, and an input signal of the atmospheric pressure conformed corrective value ($C_P$) from the atmospheric pressure conformed corrective value calculating section 187*f* (or the atmospheric pressure conformed corrective value ($C_P$) read out of the RAM when the flag is in its reset state), multiplies these input signals and produces an output signal of the upper limit air quantity ($Q_{max} \cdot C_P \cdot T_O/T$) Subsequent to the step S25, the operational sequence goes to the step S26 where the limiting section 187*h*, which has introduced therein an input signal of an average quantity ($\overline{Q}$) from the average air quantity calculating section 182 and an input signal of the upper limit air quantity ($Q_{max} \cdot C_P \cdot T_O/T$) from the multiplier 187*g*, makes judgement as to whether the average air quantity ($\overline{Q}$) is above the upper limit air flow rate ($Q_{max} \cdot C_P \cdot T_O/T$), or not. If the average air quantity is greater than the upper limit air quantity, the operational sequence proceeds to the following step S27, while, if is has not reached the upper limit air quantity, the input signal of the average air quantity ($\overline{Q}$) is produced to the charging efficiency calculating section 184, as it is. At the step S27, the limiting section 187*h* substitutes the average air quantity ($\overline{Q}$) for the upper limit air flow rate ($Q_{max} \cdot C_P \cdot T_O/T$), and produces the substituted value to the charging efficiency calculating section 184 as the average air quantity. The charging efficiency calculating section 184 divides the output from the limiting section 187*h* by the output from the engine-revolution detecting section 181, and multiplies the dividend by a predetermined coefficient, thereby finding the charging efficiency ($\eta$) and producing the obtained result from it. The operation of finding out the injection pulse width thereafter is the same as that of the conventional operations, so that the explanations therefor will be dispensed with.

By repetition of the above-mentioned operations, the injection pulse width can be sequentially obtained. Incidentally, the most recent atmospheric pressure conformed corrective value ($C_P$) which has been found by the above-mentioned calculation remains stored in the non-volatile RAM even after turning-off of the key switch.

The portion shown by the double-dot-dash line in FIGS. 3 and 6 indicates another embodiment of carrying out the filtration process on behalf of the atmospheric pressure conformed corrective value ($C_P$). In FIG. 3, the atmospheric pressure conformed corrective value calculating section 187*f* and the multiplier 187*g* are not directly connected, but they are connected through a filtration processing section 187*i* as shown by the double-dot-and-dash line in the drawing. The remaining construction is exactly same as the above-mentioned embodiment. While there is no difference in the operating flow between FIGS. 4 and 5, there is interposed, in FIG. 6, step S28 between the step S23 and the step S24, as shown by the double-dot-and-dash line. In more detail, at the step S28, the filtration processing section 187*i*, which has introduced thereinto an input signal of the atmospheric pressure conformed corrective value ($C_P$) from the atmospheric pressure conformed corrective value calculating section 187*f*, calculates the current atmospheric pressure conformed corrective value [$C_P(i)$]by the filtration process in accordance with the following Equation (4).

$$C_P(i) = K \cdot C_P(i-1) + (1-k)C_P \quad (4)$$

(where K is a constant to satisfY a relationship of $0 < K \geqq 1$; and $C_P(i-1)$ denotes a previous pressure conformed corrective value which is found out by the filtration process).

After the judgement of the flag resetting at the step S21 or after the processing at the step S28, the operational sequence proceeds to the subsequent step S24 onward. In this case, use is made of the atmospheric pressure conformed corrective value [$C_P(i)$] which has been subjected to the filtration process, as the atmospheric pressure conformed corrective value. This can be well understood from replacement of the atmospheric pressure conformed corrective value ($C_P$) at the steps S25 to S27 with the current atmospheric pressure conformed corrective value ($C_P(i)$).

Further, in each of the above-described embodiments, the air temperature correcting section 187*c* as shown by the broken line in FIG. 3 is not always required, but it can be deleted. In this case, the terms $T_O/T$ and $T/T_O$ are deleted from both FIGS. 3 and 6.

Figure 7:
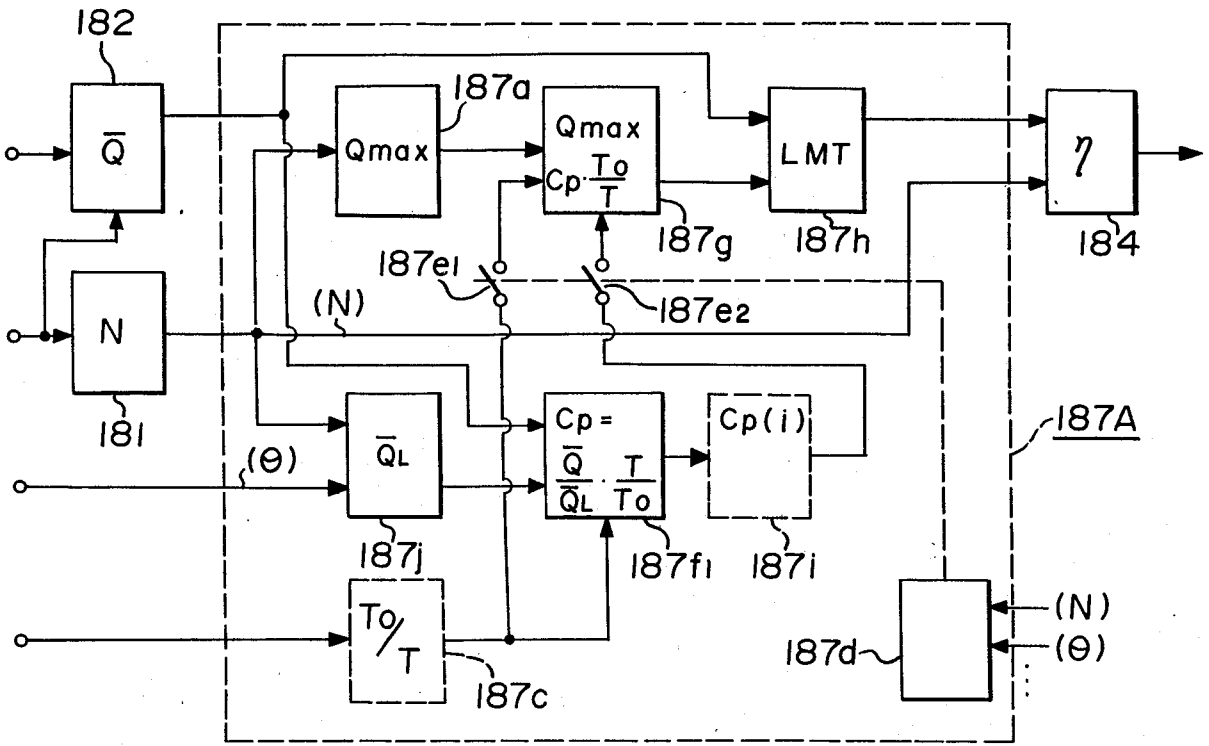
FIG. 7 is a block diagram showing an internal structure of the CPU according to the second embodiment of the present invention.
Figure 8:
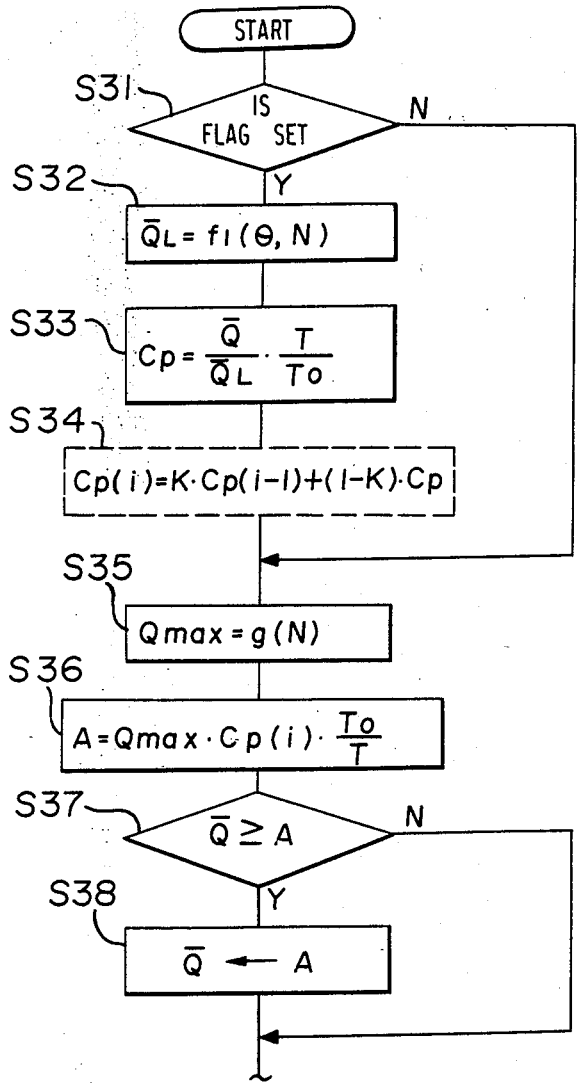
FIG. 8 is a flow chart showing the operational sequences of the CPU shown in FIg. 7.

FIGS. 7 and 8 illustrate other embodiment of the fuel injection system according to the present invention, wherein a ratio of the air flow rate is used in place of the ratio of the charging efficiency, when the atmospheric pressure conformed corrective value ($C_P$) is produced, because the charging efficiency is in a proportional relationship with the air flow rate, In FIG. 7, those parts designated by the same reference numerals indicate identical or corresponding parts as in FIG. 3. A reference numeral 187*j* designates a reference average air quantity calculating section, which stores therein a reference average air quantity ($\overline{Q}_L$) in the form of the mapping data with the throttle valve opening degree ($\theta$) and the number of engine-revolution (N) under the reference atmospheric conditions [atmospheric pressure ($P_O$) and temperature ($T_O$)] as the parameter. A reference numeral 187$e_1$ denotes the first switch provided between the output terminal of the air temperature correcting section 187*c* and the input terminal of the multiplier 187*g*. A reference numeral 187$e_2$ represents the second switch provided between the output terminal of the filtration processing section 187*i* and the input terminal of the multiplier 187*g*. These switches 187$e_1$ and 187$e_2$ are on-off controlled by the condition judging section 187*d*. Further, the input terminals of the atmospheric pressure conformed corrective value calculating section 187$f_1$ which calculates the atmospheric pressure conformed corrective value ($C_P$) are connected to each output terminal of the average air quantity calculating section 182, the air temperature correcting section 187*c* and the reference air quantity calculating section 187*j*. A reference numeral 187A denotes an air quantity limiter, which is constructed with various elements within an enclosure shown by the broken line. It is to be noted that the flow process charts in FIG. 4 and 5 are applicable to this embodiment as they are, while FIG. 8 is used in place of FIG. 6.

In the subsequent step S31, the first switch 187*e*$_1$ and the second switch 187*e*$_2$ are turned on, at the time of judging the flag set. In the subsequent step S32, the reference air quantity calculating section 187*j* extracts the reference average air quantity ($\overline{Q}_L$) under the reference atmospheric conditions which correspond to the number of engine-revolution (N) and throttle valve opening degree ($\theta$), based on the input signals of these two parameters. In the subsequent step S33, the atmospheric pressure conformed corrective value calculating section 187*f*, which has introduced therein an input signal ($\overline{Q}_L$) from the reference air quantity calculating section 187*j*, an input signal of (Q) from the average air quantity calculating section 182, and an input signal of ($T_O/T$) from the temperature correcting section 187*c*, performs the arithmetic operation of the atmospheric pressure conformed corrective value ($C_P$) in accordance with the following Equation (5).

$$C_P=\overline{Q}\overline{Q}_L/T/T_O \quad (5)$$

In the subsequent step S34, the filtration processing section 187*i* carries out the same filtration processing as in the Equation (4) for the above-mentioned embodiment. The thus filtration-processed atmospheric pressure conformed corrective value [$C_P$(i)] is produced to the multiplier 187*g* as an output thereto. However, at the time of judging the flag reset at the step S30, the second switch 187*e*$_2$ is off, and the previous atmospheric pressure conformed corrective value is read out of the RAM as the current atmospheric pressure conformed corrective value [$C_P$(i)] and is introduced as an input into the multiplier 187*g*. The subsequent steps S35 to S38 correspond respectively to the steps S24 to S27 in FIG. 6, whereby the same sequential operations are effected.

In the above-described embodiment of the present invention, when no filtration process is required, the filtration processing section 187*i* in FIG. 7 may be deleted, hence the step S34 from FIG. 8.

Also, in the above-described embodiment of FIGS. 7 and 8, the air temperature correcting section 187*c* is not always necessary, which may therefore be deleted. In this case, the terms $T/T_O$ and $T_O/T$ are also deleted.

Figure 9:
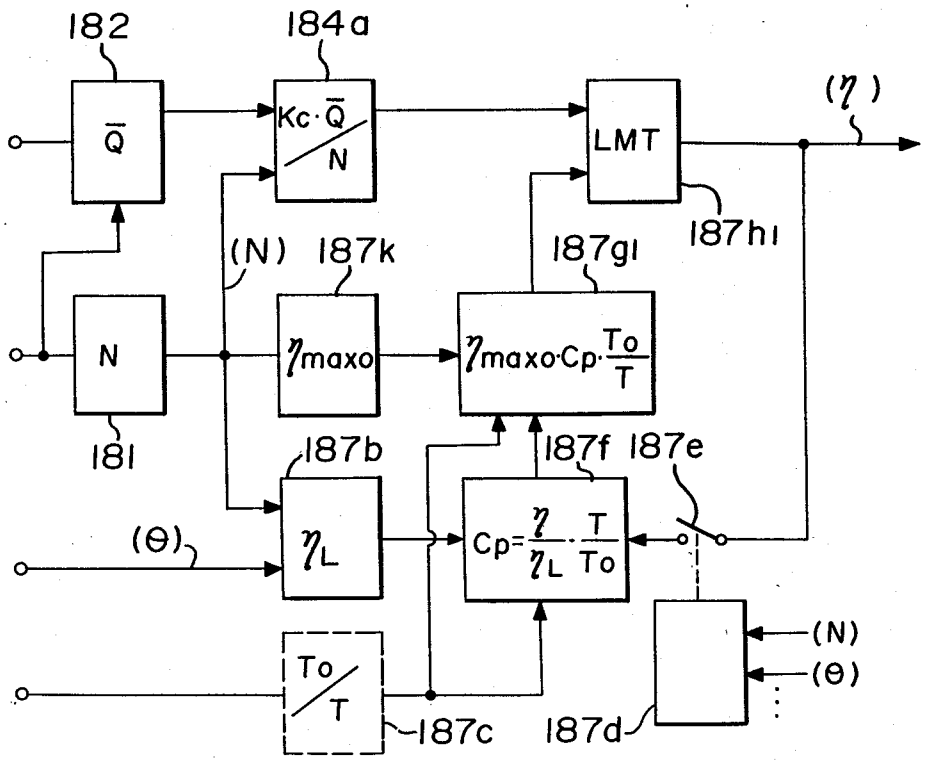
FIG. 9 is a block diagram showing an internal structure of the CPU according to the third embodiment of the present invention.
Figure 10:
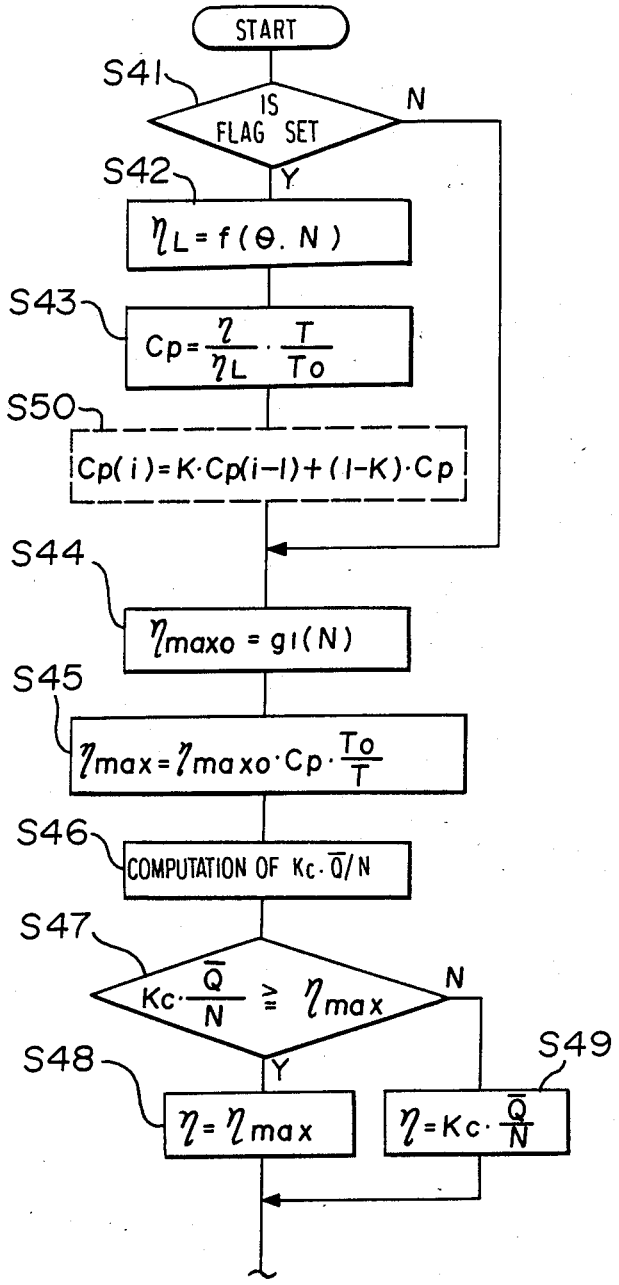
FIG. 10 is a flow chart showing operational sequences of the CPU shown in FIG. 9.

FIGS. 9 and 10 illustrates still another embodiment of the present invention, in which the charging efficiency is directly limited. In FIG. 9, the same reference numerals as those in FIG. 3 designate the identical parts and their connections are exactly same as those in FIG. 3, hence the explanations thereof will be dispensed with. In the drawing, a reference numeral 184*a* designates a charging efficiency calculating section which introduces thereinto an input signal of the number of revolution (N) from the engine-revolution detecting section 181 as well as an input signal of an average air quantity (Q) from the average air quantity calculating section 182 to thereby calculate a tentative charging efficiency with use of these input signals and a pre-established constant ($K_c$); a reference numeral 187*k* denotes a reference maximum charging efficiency computing section which stores therein a reference maximum charging efficiency ($\eta_{maxO}$) in the form of the mapping data, with the number of engine-revolution (N) as the parameter under the reference atmospheric conditions [the atmospheric pressure ($P_O$) and the temperature ($T_O$)]; a numeral 187*g*$_1$ refers to a multiplier for calculating an upper limit value of the charging efficiency, the input terminals of which are connected with output terminals of the air temperature correcting section 187*c*, the atmospheric pressure conformed corrective value calculating section 187*f*, and the reference maximum charging efficiency computing section 187*k*; and a reference numeral 187*h*$_1$ represents the charging efficiency limiting section which functions to judge whether the output from the charging efficiency calculating section 184*a* is greater than the output from the multiplier 187*g*$_1$, or not, according to which result of judgement it limits the charging efficiency and produces the limited value as an output therefrom. By the way, the output terminal of this charging efficiency limiting section 187*h*$_1$ is connected to a well known block at the later stage of the operational sequence (which is not shown in the drawing), and is also connected to one input terminal of the atmospheric pressure conformed corrective value calculating section 187*f* through the switch 187*e*.

In the following, explanations will be given, in reference to the flow chart of FIG. 10, as to the operations of the fuel injection system shown in FIG. 9. Incidentally, for the initialization and the operation of the condition-judging section 187*d* the flow charts of FIGS. 4 and 5 are employed and the explanations therefor will be dispensed with. Also, the judgement at the step S41 as to whether the flag is in its set state, or not, the extraction of the reference charging efficiency ($\eta_L$) at the step S42, and the calculation of the atmospheric pressure conformed corrective value ($C_P$) at the step S43 are the same as in the steps S21 to S23, hence the explanations thereof will be dispensed with. After the process at the step S43 or the judgement of the flag resetting at the step S41, the operational sequence proceeds to the subsequent step S44 where the reference maximum charging efficiency computing section 187*K* extracts from the mapping data the reference maximum charging efficiency ($\eta_{maxO}$) corresponding to the number of engine-revolution (N) on the basis of an input signal of the number of engine-revolution (N) which the computing section introduced from the engine-revolution detecting section 181, and produces the extracted reference maximum charging efficiency as an output therefrom. Subsequently, the operational sequence goes to the step S45 where the multiplier 187*g*$_1$ introduces thereinto an output of $T_O/T$ from the air temperature correcting section 187*c*, an output ($C_P$) from the atmospheric pressure conformed corrective value calculating section 187*f*, and an output of ($\eta_{maxO}$) from the reference maximum charging efficiency computing section 187*k*, and multiplies these input signals to thereby compute the maximum charging efficiency ($\eta_{max}$). As the result, the following Equation (6) is established.

$$\eta_{max}=\eta_{maxO}\cdot C_P T_O/T \quad (6)$$

After the step S45, the operational sequence proceeds to the step S46 where the charging efficiency calculating section 184*a* multiplies a pre-established constant ($K_c$) on a value which was obtained by dividing an average air quantity ($\overline{Q}$) with a number of engine-revolution (N) based on the input signals from the average air quantity calculating section 182 and the engine-revolution detecting section 181, thereby producing an output signal of the charging efficiency value ($K_c \cdot \overline{Q}N$). Subsequently, at the step S47, the charging efficiency limiting section 187$h_1$ introduces thereinto the input signals of ($K_c \cdot \overline{Q}N$) from the charging efficiency calculating section 184*a* and ($\eta_{max}$) from the multiplier 187$g_1$, and makes judgement as to whether the charging efficiency value ($K_c \cdot \overline{Q}N$) is greater than the maximum charging efficiency ($\eta_{max}$), or not. If the charging efficiency value is greater than the maximum charging efficiency, the maximum charging efficiency ($\eta_{max}$) is outputted as the charging efficiency ($\eta$). If, on the contrary, the charging efficiency value is below the maximum charging efficiency, the former value is outputted as the charging efficiency ($\eta$).

Incidentally, when the atmospheric pressure conformed corrective value ($C_P$) is subjected to the filtration process, it may be sufficient that a filtration processing section (not shown in the drawing) is interposed, in FIG. 9, between the atmospheric pressure conformed corrective value calculating section 187*f* and the multiplier 187$g_1$, and that the step S50 for the filtration process is interposed, in FIG. 10, between the steps S13 and S44. Further, in each of the above-described embodiments of the present invention, the air temperature correcting section 187*c* is not always necessary, but it may be removed as the case may be. In the case its removal, the terms $T_O/T$ and $T/T_O$ in FIGS. 9 and 10 are also eliminated.

Furthermore, in each of the above-described embodiments, an error may be permitted to some extent for the atmospheric pressure corrective value. In practice, however, it is more desirable that a coefficient be established in advance so as to bring the error to the positive (+) side, by taking a marginal fluctuation, or giving an offset to it.

Moreover, while, in each of the above-described embodiments of the present invention, no correction is made as regards the influence of air which passes through the by-pass air regulator, it may be feasible to correct the atmospheric pressure conformed corrective value by an air flow rate as passed through the by-pass air regulator or an estimated value of such air.

As has been stated in the foregoing, since the present invention is so constructed that the fuel injection quantity is corrected in conformity to the atmospheric pressure without use of the atmospheric pressure sensor, there can be obtained the efficient fuel injection system at a low manufacturing cost.

Although, in the foregoing, the present invention has been described with particular reference to several preferred embodiments thereof, it should be understood that these embodiments are merely illustrative of the invention and not so restrictive, and that any changes and modifications may be made to the whole or a part of the fuel injection system by those persons skilled in the art without departing from the spirit and scope of the invention as recited in the appended claims.

What is claimed is:

1. A fuel injection system for internal combustion engine which comprises in combination: a fuel injection valve for supplying fuel to the internal combustion engine; air quantity measuring means for measuring a quantity of air passing through an air intake passageway of said internal combustion engine in both forward and backward directions; engine-revolution detecting means for detecting number of revolution of said internal combustion engine; condition detecting means for detecting each and every condition of said internal combustion engine; limiting means which is used when an output therefrom produces a time width of a pulse to be imparted to said fuel injection valve, and which is for limiting a variable related to the atmospheric pressure containing therein at least a quantity of air as measured by said air quantity measuring means with a limited value corresponding to the number of the engine-revolution; and atmospheric pressure conformed corrective value computing means, which stores therein reference values for said variables under predetermined atmospheric conditions with at least the number of engine-revolution as a parameter, and which computes the atmospheric pressure conformed corrective value during a predetermined operating condition by introducing thereinto an input signal corresponding to said parameter from said internal combustion engine condition detecting means and an output signal from at least one of said air quantity measuring means and said limiting means, said limiting means correcting said limited value in conformity to the atmospheric pressure by said atmospheric pressure conformed corrective value.

2. A fuel injection system for internal combustion engine according to claim 1, characterized in that said limited variable is charging efficiency.

3. A fuel injection system for internal combustion engine according to claim 1, wherein said limited variable is a related value related to the charging efficiency.

4. A fuel injection system for internal combustion engine according to claim 3, wherein said value related to the charging efficiency is quantity of air.

5. A fuel injection system for internal combustion engine according to claim 1, 2, 3 or 4, wherein said predetermined operating conditions are that a degree of opening of a throttle valve and a number of engine-revolution as detected by said internal combustion engine condition detecting means are within predetermined ranges.

6. A fuel injection system for internal combustion engine according to claim 1, 2, 3 or 4, wherein said predetermined operating conditions are that the temperature of cooling water in said internal combustion engine as detected by said internal combustion engine condition detecting means is above a predetermined value.

7. A fuel injection system for internal combustion engine according to claim 1, 2, 3 or 4, wherein said predetermined operating conditions exclude a non-loaded condition of said internal combustion engine.

8. A fuel injection system for internal combustion engine according to claim 1, 2, 3 or 4, wherein said predetermined operating conditions exclude a transition state of said internal combustion engine.

9. A fuel injection system for internal combustion engine according to claim 1, 2, 3 or 4, wherein said internal combustion engine condition detecting means detects a temperature of air to be taken into said internal combustion engine, and said atmospheric pressure conformed corrective value computing means introduces said detected value as an input thereinto and corrects said atmospheric pressure conformed corrective value in conformity to the temperature as detected.

10. A fuel injection system for internal combustion engine according to claim 1, 2, 3 or 4, wherein said atmospheric pressure conformed corrective value computing means subjects said atmospheric pressure conformed corrective value to filtration processing.

11. A fuel injection system for internal combustion engine according to claim 1, 2, 3 or 4, further comprising a non-volatile memory which functions to store therein a computed or filtered atmospheric pressure conformed corrective value, even after turning-off of a key switch.

* * * * *